US008357487B2

(12) United States Patent
Liu et al.

(10) Patent No.: US 8,357,487 B2
(45) Date of Patent: Jan. 22, 2013

(54) METHOD OF DEGUMMING JUTE FIBRES WITH COMPLEX ENZYME (1)

(75) Inventors: Guozhong Liu, Jiangsu (CN); Zhenhua Zhang, Jiangsu (CN)

(73) Assignee: Jiangsu Redbud Textile Technology (CN)

( * ) Notice: Subject to any disclaimer, the term of this patent is extended or adjusted under 35 U.S.C. 154(b) by 328 days.

(21) Appl. No.: 12/680,460

(22) PCT Filed: Sep. 26, 2008

(86) PCT No.: PCT/CN2008/001658

§ 371 (c)(1), (2), (4) Date: Mar. 26, 2010

(87) PCT Pub. No.: WO2009/049483

PCT Pub. Date: Apr. 23, 2009

(65) Prior Publication Data

US 2010/0240113 A1 Sep. 23, 2010

(30) Foreign Application Priority Data

| | | |
|---|---|---|
| Sep. 27, 2007 | (CN) | 2007 1 0122577 |
| Sep. 27, 2007 | (CN) | 2007 1 0122596 |
| Sep. 27, 2007 | (CN) | 2007 1 0122597 |
| Sep. 27, 2007 | (CN) | 2007 1 0122599 |
| Sep. 27, 2007 | (CN) | 2007 1 0122600 |

(51) Int. Cl.
*C12Q 1/00* (2006.01)

(52) U.S. Cl. ..... 435/4; 435/14; 435/200

(58) Field of Classification Search ..... 435/4, 14, 435/200, 195

See application file for complete search history.

(56) References Cited

U.S. PATENT DOCUMENTS 4,617,383 A * 10/1986 Jaskowski ..... 536/2
7,741,089 B2 * 6/2010 Hitchman et al. ..... 435/189

* cited by examiner

*Primary Examiner* — Susan Hanley
*Assistant Examiner* — Bin Shen
(74) *Attorney, Agent, or Firm* — Schwegman Lundberg & Woessner, P.A.

(57) ABSTRACT

A method of degumming jute fibres with complex enzyme, wherein said complex enzyme comprises pectinase and laccase, wherein comprising the steps of: a. soaking the jute fibres in the water solution of said complex enzyme made from pectinase and laccase, wherein the weight proportion of said complex enzyme water solution and jute fibres ranges from 12:1 to 40:1; b. adjusting the PH value of said complex enzyme water solution to more than 5.0, but no more than 6.5, and adjusting the temperature of said complex enzyme water solution to 35° C.-65° C., then keeping said complex enzyme water solution with such temperature value for 20-120 minutes; c. adjusting the PH value of said complex enzyme water solution to 7.5-9.5, and adjusting the temperature of said complex enzyme water solution to 40° C.-70° C.; then, keeping said complex enzyme water solution with such temperature value for 20-120 minutes; d. conducting enzyme deactivation of the jute fibres processed with said complex enzyme.

6 Claims, No Drawings

METHOD OF DEGUMMING JUTE FIBRES WITH COMPLEX ENZYME (1)

Related Applications

This application is a nationalization under 35 U.S.C. 371 of PCT/CN2008/001658, filed Sep. 26, 2008, and published as WO 2009/049483 A1 on Apr. 23, 2009, which claims priority to Chinese Patent Application Serial No. 200710122597.7, filed Sep. 27, 2007; Chinese Patent Application Serial No. 200710122596.2, filed Sep. 27, 2007; Chinese Patent Application Serial No. 200710122577.X, filed September 27, 2007; Chinese Patent Application Serial No. 200710122599.6, filed Sep. 27, 2007; and Chinese Patent Application Serial No. 200710122600.5, filed Sep. 27, 2007, which applications and publication are incorporated herein by reference in their entirety and made a part hereof.

TECHNICAL FIELD

The present invention relates to a method of degumming jute fibres, in particular, relates to a method of degumming jute fibres with complex enzyme.

BACKGROUND

Bast fabrics have gained more and more popularity with people, due to better moisture absorption & breathing, low electrostatic susceptibility, and the antibacterial strength of bast fibres. For making the bast fabrics, the materials adopted can mainly be linen fibre, and ramie fibre, or the fibre combination of said fibres with other fibres, such as cotton fibres, wool fibres, chemical fibres, silk fibres after being blended spun. Linen or ramie is expensive, and this is also the reason why the bast-fabric clothing has not been applied widely. However, Jute, which is cheaper than linen and ramie, has better hygroscopicity and drapability than linen and ramie, and also has great antibiotic ability. Therefore, jute has huge potentiality and application value in clothing making industry. As the content of lignin within jute is relatively high, which is several times as much as that within linen, it is not effective to degum jute fibres and remove the lignin from jute by using the existing degumming technology. And this greatly restrains the application of jute in making clothing. <The Effect of Enzyme Treatment on Jute fibres> published in《Journal of Tianjin Industrial University》volume 24 of Aug. 2005 introduces the effect of cellulose, hemicellulase, ligninase and pectin depolymerise used in processing the jute fibres, but this article only introduces the method of processing jute fibres using single one of above mentioned enzymes. Although, there are some paragraphs in which the methods of complex enzyme treatment are mentioned, it only refers to the complex enzyme obtained via mixing laccase and cellulose enzyme or mixing hemicellulase enzyme and cellulose enzyme. However, it is testified in practice that it is not effective to remove lignin from jute fibres using the degumming method published in this article. Chinese Patent publication No CN 1232691C introduces a method of degumming jute using complex enzyme. In the method, pectinase and laccase are used to produce a complex enzyme for degumming jute fibres, and the degummed jute fibres, after blended spun or interlaced with other fibres such as cotton fibres and chemical fibres, can generally meet the requirements for clothing materials. However, the effect of removing lignin from jute fibres in such prior art, is still not good enough, as the removal rate is only about 76%. The content of lignin remaining in the jute fibres is still very high. Further more the intensity and the breaking elongation ratio of the jute fibres obtained are still not good enough. Therefore, there is a need of blended spinning or interlacing jute fibres with other fibres such as cotton fibres, and chemical fibres, when making the clothing materials. However, the quality of clothing materials made through blended spinning or interlacing jute fibres with other fibres such as cotton fibres, and chemical fibres still needs to be improved.

BRIEF DESCRIPTION OF INVENTION

The present invention introduces the first method of degumming jute fibres with complex enzyme to effectively remove pectin and lignin from said jute fibres.

In the first method of degumming jute fibres with complex enzyme, wherein said complex enzyme comprises pectinase and laccase, wherein comprising the steps of:

a. soaking the jute fibres in the water solution of said complex enzyme made from pectinase and laccase, wherein the weight proportion of said complex enzyme water solution and jute fibres ranges from 12:1 to 40:1;
b. adjusting the PH value of said complex enzyme water solution to more than 5.5, but no more than 6.5, and adjusting the temperature of said complex enzyme water solution to 35° C.-65° C., then keeping said complex enzyme water solution with such temperature value for 20-120 minutes;
c. adjusting the PH value of said complex enzyme water solution to 7.5-9.5, and adjusting the temperature of said complex enzyme water solution to 40° C.-70° C.; then, keeping said complex enzyme water solution with such temperature value for 20-120 minutes;
d. conducting enzyme deactivation of the jute fibres processed with said complex enzyme.

The first method, wherein said jute fibres are accumulation stored before the step d.

The first method, wherein the duration of accumulation storing said jute fibres ranges from 6 to 24 hours.

The first method, wherein the enzyme deactivation of jute fibres in the step d is through washing with hot water or adjusting the PH value of jute fibres, or through the combination of the two means.

The first method, wherein the weight percentage of pectinase in said complex enzyme ranges from 30% to 90%.

The first method, wherein the weight proportion of said complex enzyme and jute fibres ranges from 0.5:100 to 5:100.

The first method, wherein the temperature of said hot water is above 75°; the PH value of jute fibres is adjusted to above 10.0 or below 4.0.

The first method, wherein said jute fibres is pre-processed before the step a.

The first method, wherein the pre-processing of said jute fibres is either through one of the means of water bath, acid bath, and soaking with hydrogen Peroxide, or through the combination of at least two of the three means.

The first method, wherein the temperature of water bath ranges from 30° C. to 65° C.; said acid is sulphuric acid or acetic acid.

The present invention introduces the second method of degumming jute fibres with complex enzyme to effectively remove pectin and lignin from said jute fibres.

In the second method of degumming jute fibres with complex enzyme, wherein said complex enzyme comprises pectinase and laccase, wherein comprising the steps of:

a. soaking the jute fibres in the water solution of said complex enzyme made from pectinase and laccase, wherein the weight proportion of said complex enzyme water solution and jute fibres ranges from 12:1 to 40:1;

b. adjusting the PH value of said complex enzyme water solution to 5.0-5.5, and adjusting the temperature of said complex enzyme water solution to above 35° C., but below 55° C., then keeping said complex enzyme water solution with such temperature value for 20-120 minutes;

c. adjusting the PH value of said complex enzyme water solution to 7.5-9.5, and adjusting the temperature of said complex enzyme water solution to 40° C.-70° C.; then, keeping said complex enzyme water solution with such temperature value for 20-120 minutes;

d. conducting enzyme deactivation of the jute fibres processed with said complex enzyme.

The second method, wherein said jute fibres are accumulation stored before the step d.

The second method, wherein the duration for accumulation storing said jute fibres ranges from 6 to 24 hours.

The second method, wherein the enzyme deactivation of jute fibres in the step d is through washing with hot water or adjusting the PH value of jute fibres, or through the combination of the two means.

The second method, wherein the weight percentage of pectinase in said complex enzyme ranges from 30% to 90%.

The second method, wherein the weight proportion of said complex enzyme and jute fibres ranges from 0.5:100 to 5:100.

The second method, wherein the temperature of said hot water is above 75° C.; the PH value of jute fibres is adjusted to above 10.0 or below 4.0.

The second method, wherein said jute fibres is pre-processed before the step a.

The second method, wherein pre-processing said jute fibres is either through one of the means of water bath, acid bath, and soaking with Hydrogen Peroxide, or through at least two of the three means.

The second method, wherein the temperature of water bath ranges from 30° C. to 100° C.; said acid is sulphuric acid or acetic acid.

The present invention introduces the third method of degumming jute fibres with complex enzyme to effectively remove pectin and lignin from said jute fibres.

In the third method of degumming jute fibres with complex enzyme, wherein said complex enzyme comprises pectinase and laccase, wherein comprising the steps of:

a. soaking the jute fibres in the water solution of said complex enzyme made from pectinase and laccase, wherein the weight proportion of said complex enzyme water solution and jute fibres is equal to or larger than 12:1, but smaller than 15:1;

b. adjusting the PH value of said complex enzyme water solution to 5.0-5.5, and adjusting the temperature of said complex enzyme water solution to 55°-600°, then keeping said complex enzyme water solution with such temperature value for 25-50 minutes;

c. adjusting the PH value of said complex enzyme water solution to 7.5-8.0, and adjusting the temperature of said complex enzyme water solution to 60° C.-70° C.; then, keeping said complex enzyme water solution with such temperature value for 25-50 minutes;

d. conducting enzyme deactivation of the jute fibres processed with said complex enzyme.

The third method, wherein said jute fibres are accumulation stored before the step d.

The third method, wherein the duration of accumulation storing said jute fibres ranges from 6 to 24 hours.

The third method, wherein the enzyme deactivation of jute fibres in the step d is through washing with hot water or adjusting the PH value of jute fibres, or through the combination of the two means.

The third method, wherein the weight percentage of pectinase in said complex enzyme ranges from 30% to 90%.

The third method, wherein the weight proportion of said complex enzyme and jute fibres ranges from 0.5:100 to 5:100.

The third method, wherein the temperature of said hot water is above 75°; the PH value of jute fibres is adjusted to above 10.0 or below 4.0.

The third method, wherein said jute fibres is pre-processed before the step a.

The third method, wherein the pre-processing of said jute fibres is either through one of the means of water bath, acid bath, and soaking with hydrogen Peroxide, or through the combination of at least two of the three means.

The third method, wherein the temperature of water bath ranges from 30° C. to 100° C.; said acid is sulphuric acid or acetic acid.

The present invention introduces the fourth method of degumming jute fibres with complex enzyme to effectively remove pectin and lignin from said jute fibres.

In the fourth method of degumming jute fibres with complex enzyme, wherein said complex enzyme comprises pectinase and laccase, wherein comprising the steps of:

a. soaking the jute fibres in the water solution of said complex enzyme made from pectinase and laccase, wherein the weight proportion of said complex enzyme water solution and jute fibres is larger than 15:1, but no more than 40:1;

b. adjusting the PH value of said complex enzyme water solution to 5.0-5.5, and adjusting the temperature of said complex enzyme water solution to 55° C.-60° C., then keeping said complex enzyme water solution with such temperature value for 25-50 minutes;

c. adjusting the PH value of said complex enzyme water solution to 7.5-8.0, and adjusting the temperature of said complex enzyme water solution to 60° C.-70° C.; then, keeping said complex enzyme water solution with such temperature value for 25-50 minutes;

d. conducting enzyme deactivation of the jute fibres processed with said complex enzyme.

The fourth method, wherein said jute fibres are accumulation stored before step d.

The fourth method, wherein the duration for accumulation storing said jute fibres ranges from 6 to 24 hours.

The fourth method, wherein the enzyme deactivation of jute fibres in step d is through washing with hot water or adjusting the PH value of jute fibres, or through the combination of the two means.

The fourth method, wherein that the weight percentage of pectinase in said complex enzyme ranges from 30% to 90%.

The fourth method, wherein the weight proportion of said complex enzyme and jute fibres ranges from 0.5:100 to 5:100.

The fourth method, wherein that the temperature of said hot water is above 75° C.; the PH value of jute fibres is adjusted to above 10.0 or below 4.0.

The fourth method, wherein that said jute fibres is pre-processed before the step a.

The fourth method, wherein that pre-processing said jute fibres is either through one of the means of water bath, acid bath, and soaking with Hydrogen Peroxide, or through the combination of at least two of the three means.

The fourth method, wherein that the temperature of water bath ranges from 30° C. to 100° C.; said acid is sulphuric acid or acetic acid.

The present invention introduces the fifth method of degumming jute fibres with complex enzyme to effectively remove pectin and lignin from said jute fibres.

In the fifth method of degumming jute fibres with complex enzyme, wherein said complex enzyme comprises pectinase and laccase, wherein comprising the steps of:

a. soaking the jute fibres in the water solution of said complex enzyme made from pectinase and laccase, wherein the weight proportion of said complex enzyme water solution and jute fibres is 15:1, and the weight proportion of said complex enzyme and jute fibres is equal to or larger than 0.5:100, but smaller than 1:100;
b. adjusting the PH value of said complex enzyme water solution to 5.0-5.5, and adjusting the temperature of said complex enzyme water solution to 55°-60°, then keeping said complex enzyme water solution with such temperature value for 25-50 minutes;
c. adjusting the PH value of said complex enzyme water solution to 7.5-8.0, and adjusting the temperature of said complex enzyme water solution to 60° C.-70° C.; then, keeping said complex enzyme water solution with such temperature value for 25-50 minutes;
d. conducting enzyme deactivation of the jute fibres processed with said complex enzyme.

The fifth method, wherein said jute fibres are accumulation stored before the step d.

The fifth method, wherein the duration of accumulation storing said jute fibres ranges from 6 to 24 hours.

The fifth method, wherein the enzyme deactivation of jute fibres in the step d is through washing with hot water or adjusting the PH value of jute fibres, or through the combination of the two means.

The fifth method, wherein the weight percentage of pectinase in said complex enzyme ranges from 30% to 90%.

The fifth method, wherein the temperature of said hot water is above 75°; the PH value of jute fibres is adjusted to above 10.0 or below 4.0.

The fifth method, wherein said jute fibres is pre-processed before the step a.

The fifth method, wherein the pre-processing of said jute fibres is either through one of the means of water bath, acid bath, and soaking with hydrogen Peroxide, or through the combination of at least two of the three means.

The fifth method, wherein the temperature of water bath ranges from 30° C. to 100° C.; said acid is sulphuric acid or acetic acid.

In comparison with the prior art, the present invention has several advantages as follows:

(1) It is effective to remove pectinase and laccase from jute fibres through accumulation storing the jute fibre before conducting enzyme deactivation of said jute fibres via washing the jute fibres with hot water or adjusting its PH value, wherein the removal rate of pectinase from the jute fibres reaches about 90%, even up to 96% as its highest value; the removal rate of lignin from the jute fibres reaches about 78%, even up to 86% as its highest value. The jute fibres degummed through abovementioned method will have high spinnability.
(2) The process parameters that match with each other are used in treatment of degumming jute fibres with complex enzyme. Via adjusting the PH value of enzyme water solution to more than 5.5 (pectinase is in its highest activity when the PH value is within 4.5-5.0, and the activity of pectinase declines gradually along with the rise of PH value from 5.0), or choose a relatively low holding temperature (lower than 55° C.) while the jute fibres are in the PH value interval in which the jute fibres are in its high activity, select a suitable liquor ratio (laccase is in its highest activity, when the liquor ratio is 15, and its activity declines along with the rise or decline of the liquor ratio), or reducing the use of complex enzyme and adjusting the other process parameters used, so as to ensure the effectiveness of removing lignin from jute fibres, and to further ensure that the jute fibres with high intensity and good breaking elongation ratio can be obtained through the method of degumming of this invention (there can be a rise of the intensity which is more than 2 times as much as it was before, reaching 6-9 dN/tex, and a rise of the breaking elongation ratio which is 1.5 times as much as it was before, reaching about 5-8%), thereby making the length of jute fibres match the its fineness, so as to improving the spinnability;
(3) Pre-processing jute fibres before being degummed can swell the jute fibres, so as to better reduce the interacting force among the single fibres, facilitate the contact between enzyme water solution and jute fibres, and remove the pectin and lignin from the jute fibres.

DETAILED DESCRIPTION OF INVENTION

EXAMPLE 1

An experiment is conducted through the following steps: firstly, dividing the jute fibres into several bits, wherein each bit of jute fibres weighs about 0.5 kilogram; secondly, pre-processing the bits of jute fibres through water bath, while the temperature of water bath is 65° C., and the holding time is 2 hours; then, mixing the pectinase and laccase into complex enzyme, wherein the weight proportion of pectinase and laccase is 3:7, and the weight proportion of such complex enzyme and the jute fibres is 0.5:100; next, diluting the complex enzyme with water, in order to produce complex enzyme water solution which is 12 times in weight as much as jute fibres; after that, soaking the jute fibres in the diluted complex enzyme water solution; then, adjusting the PH value of the diluted complex enzyme water solution to 6.1 with acetic acid and sodium bicarbonate; next, heating up the complex enzyme water solution to 35° C. and keeping the solution with such temperature value for 20 minutes; after that, adjusting the PH value of the heated solution to 7.5 with sodium bicarbonate, heating up the solution to 70° C., and keeping the solution with such temperature value for 20 minutes; then, taking the jute fibres out of the solution, and accumulation storing the jute fibres for 24 hours; next, conducting enzyme deactivation of the accumulation stored jute fibres by washing the jute fibres with hot water at 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 2

An experiment is conducted through the following steps: firstly, dividing the jute fibres into several bits, wherein each bit of jute fibres weighs about 0.5 kilogram; secondly, pre-processing the bits of jute fibres through both acid bath and water bath, while the acid used for acid bath is concentrated sulphuric acid with the concentration of above 90%. The temperature of water bath is 30° C. and the holding time is 1 hour; then, mixing the pectinase and laccase into complex enzyme, wherein the weight proportion of pectinase and laccase is 9:1, and the weight proportion of such complex enzyme and the jute fibres is 5:100; next, diluting the complex enzyme with water, in order to produce complex enzyme water solution which is 40 times in weight as much as the jute fibres; after that, soaking the jute fibres in the diluted complex enzyme water solution; then, adjusting the PH value of the diluted complex enzyme water solution to 6.0 with acetic acid and sodium bicarbonate; next, heating up the complex enzyme water solution to 50° C. and keeping the solution with such temperature value for 120 minutes; after that, adjusting the PH value of the heated solution to 9.5 with sodium bicarbonate, heating up the solution to 55° C., and keeping the solution with such temperature value for 40 minutes; then, taking the jute fibres out of the solution, and accumulation storing the jute fibres for 6 hours; next, conducting enzyme deactivation of the accumulation stored jute fibres by washing the jute fibres with hot water at 95° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 3

An experiment is conducted through the following steps: firstly, dividing the jute fibres into several bits, wherein each bit of jute fibres weighs about 0.5 kilogram; secondly, preprocessing the bits of jute fibres through both acid bath, while the acid used for acid bath is acetic acid with the concentration of above 90%. then, mixing the pectinase and laccase into complex enzyme, wherein the weight proportion of pectinase and laccase is 1:1, and the weight proportion of such complex enzyme and the jute fibres is 1:100; next, diluting the complex enzyme with water, in order to produce complex enzyme water solution which is 15 times in weight as much as the jute fibres; after that, soaking the jute fibres in the diluted complex enzyme water solution; then, adjusting the PH value of the diluted complex enzyme water solution to 6.5 with acetic acid and sodium bicarbonate; next, heating up the complex enzyme water solution to 55° C. and keeping the solution with such temperature value for 40 minutes; after that, adjusting the PH value of the heated solution to 8.5 with sodium bicarbonate, heating up the solution to 50° C., and keeping the solution with such temperature value for 50 minutes; then, taking the jute fibres out of the solution, and accumulation storing the jute fibres for 10 hours; next, conducting enzyme deactivation of the accumulation stored jute fibres by washing the jute fibres with hot water at 85° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 4

An experiment is conducted through the following steps: firstly, dividing the jute fibres into several bits, wherein each bit of jute fibres weighs about 0.5 kilogram; secondly, preprocessing the bits of jute fibres through soaking the jute fibres in hydrogen peroxide with the concentration of 5 g/L. then, mixing the pectinase and laccase into complex enzyme, wherein the weight proportion of pectinase and laccase is 3:1, and the weight proportion of such complex enzyme and the jute fibres is 2:100; next, diluting the complex enzyme with water, in order to produce complex enzyme water solution which is 30 times in weight as much as the jute fibres; after that, soaking the jute fibres in the diluted complex enzyme water solution; then, adjusting the PH value of the diluted complex enzyme water solution to 6.2 with acetic acid and sodium bicarbonate; next, heating up the complex enzyme water solution to 40° C. and keeping the solution with such temperature value for 50 minutes; after that, adjusting the PH value of the heated solution to 9.0 with sodium bicarbonate, heating up the solution to 60° C., and keeping the solution with such temperature value for 90 minutes; then, taking the jute fibres out of the solution, and accumulation storing the jute fibres for 15 hours; next, conducting enzyme deactivation of the accumulation stored jute fibres by washing the jute fibres with hot water at 90° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 5

An experiment is conducted through the following steps: firstly, dividing the jute fibres into several bits, wherein each bit of jute fibres weighs about 0.5 kilogram; secondly, preprocessing the bits of jute fibres through water bath, while the temperature of water bath is 60° C., and the holding time is 3 hours; then, mixing the pectinase and laccase into complex enzyme, wherein the weight proportion of pectinase and laccase is 5:1, and the weight proportion of such complex enzyme and the jute fibres is 3:100; next, diluting the complex enzyme with water, in order to produce complex enzyme water solution which is 20 times in weight as much as jute fibres; after that, soaking the jute fibres in the diluted complex enzyme water solution; then, adjusting the PH value of the diluted complex enzyme water solution to 6.3 with acetic acid and sodium bicarbonate; next, heating up the complex enzyme water solution to 45° C. and keeping the solution with such temperature value for 60 minutes; after that, adjusting the PH value of the heated solution to 8.5 with sodium bicarbonate, heating up the solution to 40° C., and keeping the solution with such temperature value for 70 minutes; then, taking the jute fibres out of the solution, and accumulation storing the jute fibres for 20 hours; next, conducting enzyme deactivation of the accumulation stored jute fibres by washing the jute fibres with water solution, the PH value of which is 3.0; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 6

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 4:1, and the weight proportion of such complex enzyme and the jute fibres is 4:100; next, diluting the complex enzyme with water, in order to produce complex enzyme water solution which is 16 times in weight as much as jute fibres; after that, soaking the jute fibres in the diluted complex enzyme water solution; then, adjusting the PH value of the diluted complex enzyme water solution to 6.4 with acetic acid and sodium bicarbonate; next, heating up the complex enzyme water solution to 50° C.

and keeping the solution with such temperature value for 70 minutes; after that, adjusting the PH value of the heated solution to 9.0 with sodium bicarbonate, heating up the solution to 45° C., and keeping the solution with such temperature value for 80 minutes; then, taking the jute fibres out of the solution, and accumulation storing the jute fibres for 12 hours; next, conducting enzyme deactivation of the accumulation stored jute fibres by washing the jute fibres with water solution, the PH value of which is 11.0; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 7

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:3, and the weight proportion of such complex enzyme and the jute fibres is 1:100; next, diluting the complex enzyme with water, in order to produce complex enzyme water solution which is 13 times in weight as much as jute fibres; after that, soaking the jute fibres in the diluted complex enzyme water solution; then, adjusting the PH value of the diluted complex enzyme water solution to 5.7 with acetic acid and sodium bicarbonate; next, heating up the complex enzyme water solution to 60° C. and keeping the solution with such temperature value for 80 minutes; after that, adjusting the PH value of the heated solution to 8.0 with sodium bicarbonate, heating up the solution to 65° C., and keeping the solution with such temperature value for 100 minutes; then, taking the jute fibres out of the solution, and accumulation storing the jute fibres for 8 hours; next, conducting enzyme deactivation of the accumulation stored jute fibres by washing the jute fibres with hot water at 90° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 8

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 3:1, and the weight proportion of such complex enzyme and the jute fibres is 2:100; next, diluting the complex enzyme with water, in order to produce complex enzyme water solution which is 13 times in weight as much as jute fibres; after that, soaking the jute fibres in the diluted complex enzyme water solution; then, adjusting the PH value of the diluted complex enzyme water solution to 5.8 with acetic acid and sodium bicarbonate; next, heating the complex enzyme water solution to 65° C. and keeping the solution with such temperature value for 90 minutes; after that, adjusting the PH value of the heated solution to 7.8 with sodium bicarbonate, heating the solution to 65° C., and keeping the solution with such temperature value for 110 minutes; then, taking the jute fibres out of the solution; next, conducting enzyme deactivation of the jute fibres by washing the jute fibres with hot water, the PH value of which is 10.0 and the temperature of which is 75° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 9

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:1, and the weight proportion of such complex enzyme and the jute fibres is 1:100; next, diluting the complex enzyme with water, in order to produce complex enzyme water solution which is 16 times in weight as much as jute fibres; after that, soaking the jute fibres in the diluted complex enzyme water solution; then, adjusting the PH value of the diluted complex enzyme water solution to 5.6 with acetic acid and sodium bicarbonate; next, heating the complex enzyme water solution to 45° C. and keeping the solution with such temperature value for 100 minutes; after that, adjusting the PH value of the heated solution to 9.3 with sodium bicarbonate, heating the solution to 55° C., and keeping the solution with such temperature value for 120 minutes; then, taking the jute fibres out of the solution; next, conducting enzyme deactivation of the jute fibres by washing the jute fibres with hot water, the PH value of which is 3.5 and the temperature of which is 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 10

An experiment is conducted through the following steps: firstly, dividing the jute fibres into several bits, wherein each bit of jute fibres weighs about 0.5 kilogram; secondly, preprocessing the bits of jute fibres through water bath, while the temperature of water bath is 65° C., and the holding time is 2 hours; then, mixing the pectinase and laccase into complex enzyme, wherein the weight proportion of pectinase and laccase is 3:7, and the weight proportion of such complex enzyme and the jute fibres is 0.5:100; next, diluting the complex enzyme with water, in order to produce complex enzyme water solution which is 12 times in weight as much as jute fibres; after that, soaking the jute fibres in the diluted complex enzyme water solution; then, adjusting the PH value of the diluted complex enzyme water solution to 5.3 with acetic acid and sodium bicarbonate; next, heating the complex enzyme water solution to 35° C. and keeping the solution with such temperature value for 20 minutes; after that, adjusting the PH value of the heated solution to 7.5 with sodium bicarbonate, heating the solution to 65° C., and keeping the solution with such temperature value for 20 minutes; then, taking the jute fibres out of the solution, and accumulation storing the jute fibres for 24 hours; next, conducting enzyme deactivation of the accumulation stored jute fibres by washing the jute fibres with hot water at 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 11

An experiment is conducted through the following steps: firstly, dividing the jute fibres into several bits, wherein each bit of jute fibres weighs about 0.5 kilogram; secondly, preprocessing the bits of jute fibres through both acid bath and water bath, while the acid used for acid bath is concentrated sulphuric acid with the concentration of above 90%. The temperature of water bath is 30° and the holding time is 1 hour; then, mixing the pectinase and laccase into complex enzyme, wherein the weight proportion of pectinase and laccase is 9:1, and the weight proportion of such complex enzyme and the jute fibres is 5:100; next, diluting the complex enzyme with water, in order to produce complex enzyme water solution which is 40 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 54° C. and keeping the solution with such temperature value for 120 minutes; after that, adjusting the PH value of the heated solution to 9.5 with sodium bicarbonate, heating the solution to 55° C., and keeping the solution with such temperature value for 40 minutes; then, taking the jute fibres out of the solution, and accumulation storing the jute fibres for 6 hours; next, conducting enzyme deactivation of the accumulation stored jute fibres by washing the jute fibres with hot water at 95° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 12

An experiment is conducted through the following steps: firstly, dividing the jute fibres into several bits, wherein each bit of jute fibres weighs about 0.5 kilogram; secondly, preprocessing the bits of jute fibres through acid bath, while the acid used for acid bath is acetic acid with the concentration of above 90%. then, mixing the pectinase and laccase into complex enzyme, wherein the weight proportion of pectinase and laccase is 1:1, and the weight proportion of such complex enzyme and the jute fibres is 1:100; next, diluting the complex enzyme with water, in order to produce complex enzyme water solution which is 20 times in weight as much as the jute fibres; after that, soaking the jute fibres in the diluted complex enzyme water solution; then, adjusting the PH value of the diluted complex enzyme water solution to 5.5 with acetic acid and sodium bicarbonate; next, heating the complex enzyme water solution to 45° C. and keeping the solution with such temperature value for 40 minutes; after that, adjusting the PH value of the heated solution to 8.5 with sodium bicarbonate, heating the solution to 50° C., and keeping the solution with such temperature value for 50 minutes; then, taking the jute fibres out of the solution, and accumulation storing the jute fibres for 10 hours; next, conducting enzyme deactivation of the accumulation stored jute fibres by washing the jute fibres with hot water at 85° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 13

An experiment is conducted through the following steps: firstly, dividing the jute fibres into several bits, wherein each bit of jute fibres weighs about 0.5 kilogram; secondly, preprocessing the bits of jute fibres through soaking the jute fibres in hydrogen peroxide with the concentration of 5 g/L. then, mixing the pectinase and laccase into complex enzyme, wherein the weight proportion of pectinase and laccase is 2:1, and the weight proportion of such complex enzyme and the jute fibres is 2:100; next, diluting the complex enzyme with water, in order to produce complex enzyme water solution which is 30 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 50° C. and keeping the solution with such temperature value for 50 minutes; after that, adjusting the PH value of the heated solution to 9.0 with sodium bicarbonate, heating the solution to 60° C., and keeping the solution with such temperature value for 90 minutes; then, taking the jute fibres out of the solution, and accumulation storing the jute fibres for 15 hours; next, conducting enzyme deactivation of the accumulation stored jute fibres by washing the jute fibres with hot water at 90° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 14

An experiment is conducted through the following steps: firstly, dividing the jute fibres into several bits, wherein each bit of jute fibres weighs about 0.5 kilogram; secondly, preprocessing the bits of jute fibres through water bath, while the temperature of water bath is 100°, and the holding time is half an hour; then, mixing the pectinase and laccase into complex enzyme, wherein the weight proportion of pectinase and laccase is 5:1, and the weight proportion of such complex enzyme and the jute fibres is 3:100; next, diluting the complex enzyme with water, in order to produce complex enzyme water solution which is 12 times in weight as much as jute fibres; after that, soaking the jute fibres in the diluted complex enzyme water solution; then, adjusting the PH value of the diluted complex enzyme water solution to 5.4 with acetic acid and sodium bicarbonate; next, heating the complex enzyme water solution to 52° C. and keeping the solution with such temperature value for 60 minutes; after that, adjusting the PH value of the heated solution to 8.5 with sodium bicarbonate, heating the solution to 45° C., and keeping the solution with such temperature value for 70 minutes; then, taking the jute fibres out of the solution, and accumulation storing the jute fibres for 20 hours; next, conducting enzyme deactivation of the accumulation stored jute fibres by washing the jute fibres with water solution, the PH value of which is 11.0; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 15

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 4:1, and the weight proportion of such complex enzyme and the jute fibres is 4:100; next, diluting the complex enzyme with water, in order to produce complex enzyme water solution which is 14 times in weight as much as jute fibres; after that, soaking the jute fibres in the diluted complex enzyme water solution; then, adjusting the PH value of the diluted complex enzyme water solution to 5.5 with acetic acid and sodium bicarbonate; next, heating the complex enzyme water solution to 53° C. and keeping the solution with such temperature value for 70 minutes; after that, adjusting the PH value of the heated solution to 9.0 with sodium bicarbonate, heating the solution to 40° C., and keeping the solution with such temperature value for 80 minutes; then, taking the jute fibres out of the solution, and accumulation storing the jute fibres for 12 hours; next, conducting enzyme deactivation of the accumulation stored jute fibres by washing the jute fibres with water solution, the PH value of which is 3.0; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 16

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:3, and the weight proportion of such complex enzyme and the jute fibres is 1:100; next, diluting the complex enzyme with water, in order to produce complex enzyme water solution which is 13 times in weight as much as jute fibres; after that, soaking the jute fibres in the diluted complex enzyme water solution; then, adjusting the PH value of the diluted complex enzyme water solution to 5.1 with acetic acid and sodium bicarbonate; next, heating the complex enzyme water solution to 50° C. and keeping the solution with such temperature value for 80 minutes; after that, adjusting the PH value of the heated solution to 8.0 with sodium bicarbonate, heating the solution to 65° C., and keeping the solution with such temperature value for 100 minutes; then, taking the jute fibres out of the solution, and accumulation storing the jute fibres for 8 hours; next, conducting enzyme deactivation of the accumulation stored jute fibres by washing the jute fibres with hot water at 85° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 17

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 3:1, and the weight proportion of such complex enzyme and the jute fibres is 2:100; next, diluting the complex enzyme with water, in order to produce complex enzyme water solution which is 13 times in weight as much as jute fibres; after that, soaking the jute fibres in the diluted complex enzyme water solution; then, adjusting the PH value of the diluted complex enzyme water solution to 5.4 with acetic acid and sodium bicarbonate; next, heating the complex enzyme water solution to 35° C. and keeping the solution with such temperature value for 90 minutes; after that, adjusting the PH value of the heated solution to 7.8 with sodium bicarbonate, heating the solution to 70° C., and keeping the solution with such temperature value for 110 minutes; then, taking the jute fibres out of the solution; next, conducting enzyme deactivation of the jute fibres by washing the jute fibres with hot water, the PH value of which is 10.0 and the temperature of which is 75° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 18

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:1, and the weight proportion of such complex enzyme and the jute fibres is 1:100; next, diluting the complex enzyme with water, in order to produce complex enzyme water solution which is 16 times in weight as much as jute fibres; after that, soaking the jute fibres in the diluted complex enzyme water solution; then, adjusting the PH value of the diluted complex enzyme water solution to 5.5 with acetic acid and sodium bicarbonate; next, heating the complex enzyme water solution to 52° C. and keeping the solution with such temperature value for 100 minutes; after that, adjusting the PH value of the heated solution to 9.3 with sodium bicarbonate, heating the solution to 55° C., and keeping the solution with such temperature value for 120 minutes; then, taking the jute fibres out of the solution; next, conducting enzyme deactivation of the jute fibres by washing the jute fibres with hot water, the PH value of which is 3.5 and the temperature of which is 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 19

An experiment is conducted through the following steps: firstly, dividing the jute fibres into several bits, wherein each bit of jute fibres weighs about 0.5 kilogram, and pre-processing the jute fibres via water bath, wherein the temperature of the water is 65° C., and the holding time is 2 hour; secondly, mixing the pectinase and laccase into complex enzyme, wherein the weight proportion of pectinase and laccase is 3:7, and the weight proportion of such complex enzyme and the jute fibres is 0.5:100; next, diluting the complex enzyme with water, in order to produce complex enzyme water solution which is 14 times in weight as much as jute fibres; after that, soaking the jute fibres in the diluted complex enzyme water solution; then, adjusting the PH value of the diluted complex enzyme water solution to 5.5 with acetic acid and sodium bicarbonate; next, heating the complex enzyme water solution to 55° C. and keeping the solution with such temperature value for 25 minutes; after that, adjusting the PH value of the heated solution to 7.5 with sodium bicarbonate, heating the solution to 60° C., and keeping the solution with such temperature value for 25 minutes; then, taking the jute fibres out of the solution, and accumulation storing the jute fibres for 24 hours; next, conducting enzyme deactivation of the jute fibres by washing the jute fibres with hot water, the temperature of which is 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 20

An experiment is conducted through the following steps: firstly, dividing the jute fibres into several bits, wherein each bit of jute fibres weighs 0.5 kilogram; secondly, pre-processing the bits of jute fibres through both acid bath and water bath, while the acid used for acid bath is concentrated sulphuric acid with the concentration of above 90%. The temperature of water bath is 30° and the holding time is 1 hour; then, mixing the pectinase and laccase into complex enzyme, wherein the weight proportion of pectinase and laccase is 9:1, and the weight proportion of such complex enzyme and the jute fibres is 5:100; next, diluting the complex enzyme with water, in order to produce complex enzyme water solution which is 14 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution with such temperature value for 50 minutes; after that, adjusting the PH value of the heated solution to 7.5 with sodium bicarbonate, heating the solution to 65° C., and keeping the solution with such temperature value for 40 minutes; then, taking the jute fibres out of the solution, and accumulation storing the jute fibres for 6 hours; next, conducting enzyme deactivation of the accumulation stored jute fibres by washing the jute fibres with hot water at 95° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 21

An experiment is conducted through the following steps: firstly, dividing the jute fibres into several bits, wherein each bit of jute fibres weighs 0.5 kilogram; secondly, pre-processing the bits of jute fibres through acid bath, while the acid used for acid bath is acetic acid with the concentration of above 90%. then, mixing the pectinase and laccase into complex enzyme, wherein the weight proportion of pectinase and laccase is 1:1, and the weight proportion of such complex enzyme and the jute fibres is 1:100; next, diluting the complex enzyme with water, in order to produce complex enzyme water solution which is 12 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 40 minutes; after that, adjusting the PH value of the heated solution to 8.0 with sodium bicarbonate, heating the solution to 60° C., and keeping the solution at such temperature for 50 minutes; then, taking the jute fibres out of the solution, and accumulation storing the jute fibres for 10 hours; next, conducting enzyme deactivation of the accumulation stored jute fibres by washing the jute fibres with hot water at 85° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 22

An experiment is conducted through the following steps: firstly, dividing the jute fibres into several bits, wherein each bit of jute fibres weighs about 0.5 kilogram; secondly, pre-processing the bits of jute fibres through soaking the jute fibres in hydrogen peroxide with the concentration of 5 g/L. then, mixing the pectinase and laccase into complex enzyme, wherein the weight proportion of pectinase and laccase is 2:1, and the weight proportion of such complex enzyme and the jute fibres is 2:100; next, diluting the complex enzyme with water, in order to produce complex enzyme water solution which is 13 times in weight as much as the jute fibres; after that, soaking the jute fibres in the diluted complex enzyme water solution; then, adjusting the PH value of the diluted complex enzyme water solution to 5.3 with acetic acid and sodium bicarbonate; next, heating the complex enzyme water solution to 58° C. and keeping the solution at such temperature for 50 minutes; after that, adjusting the PH value of the heated solution to 7.8 with sodium bicarbonate, heating the solution to 70° C., and keeping the solution at such temperature for 30 minutes; then, taking the jute fibres out of the solution, and accumulation storing the jute fibres for 15 hours; next, conducting enzyme deactivation of the accumulation stored jute fibres by washing the jute fibres with hot water at 90° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 23

An experiment is conducted through the following steps: firstly, dividing the jute fibres into several bits, wherein each bit of jute fibres weighs 0.5 kilogram; secondly, pre-processing the bits of jute fibres through water bath, while the temperature of water bath is 100°, and the holding time is half an hour; then, mixing the pectinase and laccase into complex enzyme, wherein the weight proportion of pectinase and laccase is 5:1, and the weight proportion of such complex enzyme and the jute fibres is 3:100; next, diluting the complex enzyme with water, in order to produce complex enzyme water solution which is 13 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 35 minutes; after that, adjusting the PH value of the heated solution to 7.7 with sodium bicarbonate, heating the solution to 65° C., and keeping the solution at such temperature for 45 minutes; then, taking the jute fibres out of the solution, and accumulation storing the jute fibres for 20 hours; next, conducting enzyme deactivation of the accumulation stored jute fibres by washing the jute fibres with hot water at 90° C.; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 24

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 4:1, and the weight proportion of such complex enzyme and the jute fibres is 4:100; next, diluting the complex enzyme with water, in order to produce complex enzyme water solution which is 12 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution at such temperature for 45 minutes; after that, adjusting the PH value of the heated solution to 8.0 with sodium bicarbonate, heating the solution to 65° C., and keeping the solution at such temperature for 35 minutes; then, taking the jute fibres out of the solution, and accumulation storing the jute fibres for 12 hours; next, conducting enzyme deactivation of the jute fibres by washing the jute fibres with hot water, the PH value of which is 3.5 and the temperature of which is 75° C.; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 25

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:3, and the weight proportion of such complex enzyme and the jute fibres is 1:100; next, diluting the complex enzyme with water, in order to produce complex enzyme water solution which is 12 times in weight as much as jute fibres; after that, soaking the jute fibres in the diluted complex enzyme water solution; then, adjusting the PH value of the diluted complex enzyme water solution to 5.2 with acetic acid and sodium bicarbonate; next, heating the complex enzyme water solution to 57° C. and keeping the solution at such temperature for 50 minutes; after that, adjusting the PH value of the heated solution to 8.0 with sodium bicarbonate, heating the solution to 65° C., and keeping the solution at such temperature for 50 minutes; then, taking the jute fibres out of the solution, and accumulation storing the jute fibres for 8 hours; next, conducting enzyme deactivation of the accumulation stored jute fibres by washing the jute fibres with water solution, the temperature of which is 3.0; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 26

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 3:1, and the weight proportion of such complex enzyme and the jute fibres is 2:100; next, diluting the complex enzyme with water, in order to produce complex enzyme water solution which is 14 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 58° C. and keeping the solution at such temperature for 35 minutes; after that, adjusting the PH value of the heated solution to 7.8 with sodium bicarbonate, heating the solution to 70° C., and keeping the solution at such temperature for 35 minutes; then, taking the jute fibres out of the solution; next, conducting enzyme deactivation of the jute fibres by washing the jute fibres with hot water, the PH value of which is 10.0 and the temperature of which is 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 27

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:1, and the weight proportion of such complex enzyme and the jute fibres is 1:100; next, diluting the complex enzyme with water, in order to produce complex enzyme water solution which is 14 times in weight as much as jute fibres; after that, soaking the jute fibres in the diluted complex enzyme water solution; then, adjusting the PH value of the diluted complex enzyme water solution to 5.4 with acetic acid and sodium bicarbonate; next, heating the complex enzyme water solution to 56° C. and keeping the solution at such temperature for 30 minutes; after that, adjusting the PH value of the heated solution to 7.6 with sodium bicarbonate, heating the solution to 65° C., and keeping the solution at such temperature for 40 minutes; then, taking the jute fibres out of the solution; next, conducting enzyme deactivation of the jute fibres by washing the jute fibres with water solution, the PH value of which is 11.0; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 28

An experiment is conducted through the following steps: firstly, dividing the jute fibres into several bits, wherein each bit of jute fibres weighs 0.5 kilogram; secondly, pre-processing the bits of jute fibres through water bath, while the temperature of water bath is 65°, and the holding time is 2 hours; then, mixing the pectinase and laccase into complex enzyme, wherein the weight proportion of pectinase and laccase is 3:7, and the weight proportion of such complex enzyme and the jute fibres is 0.5:100; next, diluting the complex enzyme with water, in order to produce complex enzyme water solution which is 16 times in weight as much as jute fibres; after that, soaking the jute fibres in the diluted complex enzyme water solution; then, adjusting the PH value of the diluted complex enzyme water solution to 5.5 with acetic acid and sodium bicarbonate; next, heating the complex enzyme water solution to 55° C. and keeping the solution at such temperature for 25 minutes; after that, adjusting the PH value of the heated solution to 7.5 with sodium bicarbonate, heating the solution to 60° C., and keeping the solution at such temperature for 25 minutes; then, taking the jute fibres out of the solution, and accumulation storing the jute fibres for 24 hours; next, conducting enzyme deactivation of the accumulation stored jute fibres by washing the jute fibres with hot water at 80° C.; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 29

An experiment is conducted through the following steps: firstly, dividing the jute fibres into several bits, wherein each bit of jute fibres weighs about 0.5 kilogram; secondly, pre-processing the bits of jute fibres through both acid bath and water bath, wherein the acid used for acid bath is concentrated sulphuric acid with the concentration of above 90%. The temperature of water bath is 30° and the holding time is 1 hour; then, mixing the pectinase and laccase into complex enzyme, wherein the weight proportion of pectinase and laccase is 9:1, and the weight proportion of such complex enzyme and the jute fibres is 5:100; next, diluting the complex enzyme with water, in order to produce complex enzyme water solution which is 40 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution at such temperature for 50 minutes; after that, adjusting the PH value of the heated solution to 7.5 with sodium bicarbonate, heating the solution to 65° C., and keeping the solution at such temperature for 40 minutes; then, taking the jute fibres out of the solution, and accumulation storing the jute fibres for 6 hours; next, conducting enzyme deactivation of the accumulation stored jute fibres by washing the jute fibres with hot water at 95° C.; finally, the degummed jute fibres are obtained. The removal of pectin and lignin from jute fibres is indicated in the table 1. Said degummed jute fibres will be highly spinnable, after being bleached, stamped, washed, dehydrated, and dried via the prior art.

EXAMPLE 30

An experiment is conducted through the following steps: firstly, dividing the jute fibres into several bits, wherein each bit of jute fibres weighs about 0.5 kilogram; secondly, pre-processing the bits of jute fibres through acid bath, wherein the acid used for acid bath is acetic acid with the concentration of above 90%. then, mixing the pectinase and laccase into complex enzyme, wherein the weight proportion of pectinase and laccase is 1:1, and the weight proportion of such complex enzyme and the jute fibres is 1:100; next, diluting the complex enzyme with water, in order to produce complex enzyme water solution which is 35 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 40 minutes; after that, adjusting the PH value of the heated solution to 8.0 with sodium bicarbonate, heating the solution to 60° C., and keeping the solution at such temperature for 50 minutes; then, taking the jute fibres out of the solution, and accumulation storing the jute fibres for 10 hours; next, conducting enzyme deactivation of the accumulation stored jute fibres by washing the jute fibres with hot water at 85° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 31

An experiment is conducted through the following steps: firstly, dividing the jute fibres into several bits, wherein each bit of jute fibres weighs about 0.5 kilogram; secondly, pre-processing the bits of jute fibres through soaking the jute fibres in hydrogen peroxide with the concentration of 5 g/L. then, mixing the pectinase and laccase into complex enzyme, wherein the weight proportion of pectinase and laccase is 2:1, and the weight proportion of such complex enzyme and the jute fibres is 2:100; next, diluting the complex enzyme with water, in order to produce complex enzyme water solution which is 30 times in weight as much as the jute fibres; after that, soaking the jute fibres in the diluted complex enzyme water solution; then, adjusting the PH value of the diluted complex enzyme water solution to 5.3 with acetic acid and sodium bicarbonate; next, heating the complex enzyme water solution to 58° C. and keeping the solution at such temperature for 50 minutes; after that, adjusting the PH value of the heated solution to 7.8 with sodium bicarbonate, heating the solution to 70° C., and keeping the solution at such temperature for 30 minutes; then, taking the jute fibres out of the solution, and accumulation storing the jute fibres for 15 hours; next, conducting enzyme deactivation of the accumulation stored jute fibres by washing the jute fibres with hot water at 90° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 32

An experiment is conducted through the following steps: firstly, dividing the jute fibres into several bits, wherein each bit of jute fibres weighs about 0.5 kilogram; secondly, pre-processing the bits of jute fibres through water bath at the temperature of 100°, and the holding time is half an hour; then, mixing the pectinase and laccase into complex enzyme, wherein the weight proportion of pectinase and laccase is 5:1, and the weight proportion of such complex enzyme and the jute fibres is 3:100; next, diluting the complex enzyme with water, in order to produce complex enzyme water solution which is 25 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 30 minutes; after that, adjusting the PH value of the heated solution to 7.7 with sodium bicarbonate, heating the solution to 65° C., and keeping the solution at such temperature for 40 minutes; then, taking the jute fibres out of the solution, and accumulation storing the jute fibres for 20 hours; next, conducting enzyme deactivation of the accumulation stored jute fibres by washing the jute fibres with hot water at 90° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 33

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 4:1, and the weight proportion of such complex enzyme and the jute fibres is 4:100; next, diluting the complex enzyme with water, in order to produce complex enzyme water solution which is 20 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution at such temperature for 45 minutes; after that, adjusting the PH value of the heated solution to 8.0 with sodium bicarbonate, heating the solution to 65° C., and keeping the solution at such temperature for 45 minutes; then, taking the jute fibres out of the solution, and accumulation storing the jute fibres for 12 hours; next, conducting enzyme deactivation of the accumulation stored jute fibres by washing the jute fibres with hot water at 85° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 34

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:3, and the weight proportion of such complex enzyme and the jute fibres is 1:100; next, diluting the complex enzyme with water, in order to produce complex enzyme water solution which is 35 times in weight as much as jute fibres; after that, soaking the jute fibres in the diluted complex enzyme water solution; then, adjusting the PH value of the diluted complex enzyme water solution to 5.2 with acetic acid and sodium bicarbonate; next, heating the complex enzyme water solution to 57° C. and keeping the solution at such temperature for 35 minutes; after that, adjusting the PH value of the heated solution to 8.0 with sodium bicarbonate, heating the solution to 65° C., and keeping the solution at such temperature for 35 minutes; then, taking the jute fibres out of the solution, and accumulation storing the jute fibres for 8 hours; next, conducting enzyme deactivation of the accumulation stored jute fibres by washing the jute fibres with water solution, the PH value of which is 11.0; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 35

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 3:1, and the weight proportion of such complex enzyme and the jute fibres is 2:100; next, diluting the complex enzyme with water, in order to produce complex enzyme water solution which is 17 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 58° C. and keeping the solution at such temperature for 35 minutes; after that, adjusting the PH value of the heated solution to 7.8 with sodium bicarbonate, heating the solution to 70° C., and keeping the solution at such temperature for 45 minutes; then, taking the jute fibres out of the solution; next, conducting enzyme deactivation of the jute fibres by washing the jute fibres with hot water, the PH value of which is 10.0 and the temperature of which is 75° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 36

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:1, and the weight proportion of such complex enzyme and the jute fibres is 1:100; next, diluting the complex enzyme with water, in order to produce complex enzyme water solution which is 18 times in weight as much as jute fibres; after that, soaking the jute fibres in the diluted complex enzyme water solution; then, adjusting the PH value of the diluted complex enzyme water solution to 5.4 with acetic acid and sodium bicarbonate; next, heating the complex enzyme water solution to 56° C.

and keeping the solution at such temperature for 25 minutes; after that, adjusting the PH value of the heated solution to 7.6 with sodium bicarbonate, heating the solution to 65° C., and keeping the solution at such temperature for 30 minutes; then, taking the jute fibres out of the solution; next, conducting enzyme deactivation of the jute fibres by washing the jute fibres with hot water, the PH value of which is 3.0 and the temperature of which is 80° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 37

An experiment is conducted through the following steps: firstly, dividing the jute fibres into several bits, wherein each bit of jute fibres weighs 0.5 kilogram; secondly, pre-processing the bits of jute fibres through water bath, while the temperature of water bath is 65 °, and the holding time is 2 hours; then, mixing the pectinase and laccase into complex enzyme, wherein the weight proportion of pectinase and laccase is 3:7, and the weight proportion of such complex enzyme and the jute fibres is 0.8:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.5 with acetic acid and sodium bicarbonate; next, heating the complex enzyme water solution to 55° C. and keeping the solution at such temperature for 25 minutes; after that, adjusting the PH value of the heated solution to 7.5 with sodium bicarbonate, heating the solution to 60° C., and keeping the solution at such temperature for 25 minutes; then, taking the jute fibres out of the solution, and accumulation storing the jute fibres for 24 hours; next, conducting enzyme deactivation of the accumulation stored jute fibres by washing the jute fibres with hot water at 80° C.; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 38

An experiment is conducted through the following steps: firstly, dividing the jute fibres into several bits, wherein each bit of jute fibres weighs about 0.5 kilogram; secondly, pre-processing the bits of jute fibres through both acid bath and water bath, wherein the acid used for acid bath is concentrated sulphuric acid with the concentration of above 90%. The temperature of water bath is 30° and the holding time is 1 hour; then, mixing the pectinase and laccase into complex enzyme, wherein the weight proportion of pectinase and laccase is 9:1, and the weight proportion of such complex enzyme and the jute fibres is 0.9:100; next, diluting the complex enzyme with water, in order to produce complex enzyme water solution which is 15 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution at such temperature for 50 minutes; after that, adjusting the PH value of the heated solution to 7.5 with sodium bicarbonate, heating the solution to 65° C., and keeping the solution at such temperature for 40 minutes; then, taking the jute fibres out of the solution, and accumulation storing the jute fibres for 6 hours; next, conducting enzyme deactivation of the accumulation stored jute fibres by washing the jute fibres with hot water at 95° C.; finally, the degummed jute fibres are obtained. The removal of pectin and lignin from jute fibres is indicated in the table 1. Said degummed jute fibres will be highly spinnable, after being bleached, stamped, washed, dehydrated, and dried via the prior art.

EXAMPLE 39

An experiment is conducted through the following steps: firstly, dividing the jute fibres into several bits, wherein each bit of jute fibres weighs about 0.5 kilogram; secondly, pre-processing the bits of jute fibres through both acid bath, wherein the acid used for acid bath is acetic acid with the concentration of above 90%. then, mixing the pectinase and laccase into complex enzyme, wherein the weight proportion of pectinase and laccase is 1:1, and the weight proportion of such complex enzyme and the jute fibres is 0.6:100; next, diluting the complex enzyme with water, in order to produce complex enzyme water solution which is 15 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 40 minutes; after that, adjusting the PH value of the heated solution to 8.0 with sodium bicarbonate, heating the solution to 60° C., and keeping the solution at such temperature for 50 minutes; then, taking the jute fibres out of the solution, and accumulation storing the jute fibres for 10 hours; next, conducting enzyme deactivation of the accumulation stored jute fibres by washing the jute fibres with hot water at 85° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 40

An experiment is conducted through the following steps: firstly, dividing the jute fibres into several bits, wherein each bit of jute fibres weighs about 0.5 kilogram; secondly, pre-processing the bits of jute fibres through soaking the jute fibres in hydrogen peroxide with the concentration of 5 g/L. then, mixing the pectinase and laccase into complex enzyme, wherein the weight proportion of pectinase and laccase is 2:1, and the weight proportion of such complex enzyme and the jute fibres is 0.6:100; next, diluting the complex enzyme with water, in order to produce complex enzyme water solution which is 15 times in weight as much as the jute fibres; after that, soaking the jute fibres in the diluted complex enzyme water solution; then, adjusting the PH value of the diluted complex enzyme water solution to 5.3 with acetic acid and sodium bicarbonate; next, heating the complex enzyme water solution to 58° C. and keeping the solution at such temperature for 50 minutes; after that, adjusting the PH value of the heated solution to 7.8 with sodium bicarbonate, heating the solution to 70° C., and keeping the solution at such temperature for 30 minutes; then, taking the jute fibres out of the solution, and accumulation storing the jute fibres for 15 hours; next, conducting enzyme deactivation of the accumulation stored jute fibres by washing the jute fibres with hot water at 90° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 41

An experiment is conducted through the following steps: firstly, dividing the jute fibres into several bits, wherein each bit of jute fibres weighs about 0.5 kilogram; secondly, preprocessing the bits of jute fibres through water bath at the temperature of 100°, and the holding time is half an hour; then, mixing the pectinase and laccase into complex enzyme, wherein the weight proportion of pectinase and laccase is 5:1, and the weight proportion of such complex enzyme and the jute fibres is 0.5:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 30 minutes; after that, adjusting the PH value of the heated solution to 7.7 with sodium bicarbonate, heating the solution to 65° C., and keeping the solution at such temperature for 40 minutes; then, taking the jute fibres out of the solution, and accumulation storing the jute fibres for 20 hours; next, conducting enzyme deactivation of the accumulation stored jute fibres by washing the jute fibres with water solution, the PH value of which is 3.0; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 42

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 4:1, and the weight proportion of such complex enzyme and the jute fibres is 0.6:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution at such temperature for 45 minutes; after that, adjusting the PH value of the heated solution to 8.0 with sodium bicarbonate, heating the solution to 65° C., and keeping the solution at such temperature for 45 minutes; then, taking the jute fibres out of the solution, and accumulation storing the jute fibres for 12 hours; next, conducting enzyme deactivation of the accumulation stored jute fibres by washing the jute fibres with water solution, the PH value of which is 11.0; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 43

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:3, and the weight proportion of such complex enzyme and the jute fibres is 0.9:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.2 with acetic acid and sodium bicarbonate; next, heating the complex enzyme water solution to 57° C. and keeping the solution at such temperature for 35 minutes; after that, adjusting the PH value of the heated solution to 8.0 with sodium bicarbonate, heating the solution to 65° C., and keeping the solution at such temperature for 35 minutes; then, taking the jute fibres out of the solution, and accumulation storing the jute fibres for 8 hours; next, conducting enzyme deactivation of the accumulation stored jute fibres by washing the jute fibres with hot water at 90° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 44

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 3:1, and the weight proportion of such complex enzyme and the jute fibres is 0.8:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 58° C. and keeping the solution at such temperature for 35 minutes; after that, adjusting the PH value of the heated solution to 7.8 with sodium bicarbonate, heating the solution to 70° C., and keeping the solution at such temperature for 45 minutes; then, taking the jute fibres out of the solution; next, conducting enzyme deactivation of the jute fibres by washing the jute fibres with hot water, the PH value of which is 10.0 and the temperature of which is 75° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

EXAMPLE 45

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:1, and the weight proportion of such complex enzyme and the jute fibres is 0.7:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.4 with acetic acid and sodium bicarbonate; next, heating the complex enzyme water solution to 56° C. and keeping the solution at such temperature for 25 minutes; after that, adjusting the PH value of the heated solution to 7.6 with sodium bicarbonate, heating the solution to 65° C., and keeping the solution at such temperature for 30 minutes; then, taking the jute fibres out of the solution; next, conducting enzyme deactivation of the jute fibres by washing the jute fibres with hot water, the PH value of which is 3.5 and the temperature of which is 80° C.; finally, the degummed jute fibres are obtained. The removal of pectin and lignin from jute fibres is indicated in the table 1.

Said degummed jute fibres will be highly spinnable, after being bleached, stamped, washed, dehydrated, and dried via the prior art.

The pectinase (Bioprep) and the laccase (Denilite) mentioned in above examples are produced by the a Danish company called Novozymes. Table 1 illustrates the removal rates of pectinase and lignin from jute fibres of the different examples.

While this invention has been described as having several preferred embodiments, the present invention can be further modified within the spirit and scope of this disclosure. This application is therefore intended to cover any variations, uses, or adaptations of the invention using its general principles. Further, this application is intended to cover such departures from this present disclosure as come within known or customary practice in the art to which this invention pertains and which fall within the limits of the appended claims.

TABLE 1

| | Examples | | | | | | | | |
|---|---|---|---|---|---|---|---|---|---|
| | 1 | 2 | 3 | 4 | 5 | 6 | 7 | 8 | 9 |
| Removal rate of pectinase | 86% | 96% | 90% | 92% | 95% | 96% | 92% | 91% | 89% |
| Removal rate of lignin | 79% | 79% | 80% | 80% | 84% | 86% | 82% | 81% | 78% |
| | Examples | | | | | | | | |
| | 10 | 11 | 12 | 13 | 14 | 15 | 16 | 17 | 18 |
| Removal rate of pectinase | 86% | 96% | 90% | 91% | 95% | 96% | 91% | 91% | 89% |
| Removal rate of lignin | 79% | 80% | 80% | 82% | 84% | 86% | 82% | 81% | 78% |
| | Examples | | | | | | | | |
| | 19 | 20 | 21 | 22 | 23 | 24 | 25 | 26 | 27 |
| Removal rate of pectinase | 88% | 94% | 90% | 91% | 95% | 96% | 91% | 90% | 89% |
| Removal rate of lignin | 79% | 80% | 79% | 80% | 84% | 86% | 82% | 81% | 78% |
| | Examples | | | | | | | | |
| | 28 | 29 | 30 | 31 | 32 | 33 | 34 | 35 | 36 |
| Removal rate of pectinase | 88% | 96% | 88% | 91% | 95% | 96% | 91% | 90% | 89% |
| Removal rate of lignin | 79% | 80% | 79% | 80% | 84% | 86% | 82% | 81% | 78% |
| | Examples | | | | | | | | |
| | 37 | 38 | 39 | 40 | 41 | 42 | 43 | 44 | 45 |
| Removal rate of pectinase | 87% | 91% | 89% | 91% | 94% | 92% | 90% | 91% | 88% |
| Removal rate of lignin | 82% | 78% | 79% | 79% | 82% | 85% | 81% | 80% | 81% |

The invention claimed is:

1. A method of degumming jute fibres with complex enzyme, wherein said complex enzyme comprises pectinase and laccase, comprising the steps of:

a) soaking the jute fibres in a water solution of said complex enzyme made from pectinase and laccase, wherein the weight proportion of said complex enzyme water solution and jute fibres ranges from 12:1 to 40:1;

b) adjusting pH value of said complex enzyme water solution to more than 5.5, but no more than 6.5, and adjusting the temperature of said complex enzyme water solution to 35°-65°, then keeping said complex enzyme water solution with said temperature value for 20-120 minutes;

c) adjusting the pH value of said complex enzyme water solution to 7.5-9.5, and adjusting the temperature of said complex enzyme water solution to 40° C.-70° C.; then, keeping said complex enzyme water solution with said temperature value for 20-120 minutes to obtain processed jute fibres d) deactivating the enzyme complex of step c.

2. The method of claim 1, wherein said jute fibres are accumulation stored before step d) and the duration of accumulation storing said jute fibres ranges from 6 to 24 hours.

3. The method of claim 1, wherein the weight proportion of said complex enzyme and jute fibres ranges from 0.5:100 to 5:100.

4. The method of claim 1, wherein the enzyme complex is deactivated by washing the processed jute fibres with hot water or adjusting the pH of the processed jute fibres, or by a combination of said washing and said pH adjustment.

5. The method of claim 1, wherein the weight percentage of pectinase, in said complex enzyme ranges from 30% to 90%.

6. The method of claim 1, wherein said jute fibers are pre-processed before step a), wherein said pre-processing is by soaking the jute fibres in a hot water bath, or soaking the jute fibres in an acid bath, or by soaking the jute fibres with hydrogen peroxide, or by a combination of at least two of said pre-processing methods.

* * * * *